US011549692B2

(12) United States Patent
Morimoto et al.

(10) Patent No.: US 11,549,692 B2
(45) Date of Patent: Jan. 10, 2023

(54) HEATING AND HOT WATER SUPPLY SYSTEM

(71) Applicant: NORITZ CORPORATION, Hyogo (JP)

(72) Inventors: Hiroshi Morimoto, Hyogo (JP); Naoki Tsuda, Hyogo (JP); Akihisa Kageyama, Hyogo (JP); Takehito Yokoyama, Hyogo (JP)

(73) Assignee: NORITZ CORPORATION, Hyogo (JP)

( * ) Notice: Subject to any disclaimer, the term of this patent is extended or adjusted under 35 U.S.C. 154(b) by 335 days.

(21) Appl. No.: 16/629,962

(22) PCT Filed: Jul. 13, 2018

(86) PCT No.: PCT/JP2018/026558
§ 371 (c)(1),
(2) Date: Jan. 10, 2020

(87) PCT Pub. No.: WO2019/021871
PCT Pub. Date: Jan. 31, 2019

(65) Prior Publication Data

US 2021/0088224 A1 Mar. 25, 2021

(30) Foreign Application Priority Data

Jul. 24, 2017 (JP) ..... JP2017-142603

(51) Int. Cl.
*F24D 3/08* (2006.01)
*F24H 1/52* (2022.01)

(52) U.S. Cl.
CPC ..... *F24D 3/08* (2013.01); *F24H 1/52* (2013.01)

(58) Field of Classification Search
None
See application file for complete search history.

(56) References Cited

U.S. PATENT DOCUMENTS 3,388,860 A * 6/1968 Kruper ..... G05D 23/24 236/1 C
2018/0073748 A1* 3/2018 Gagne ..... F24H 1/52

FOREIGN PATENT DOCUMENTS

GB 1543546 4/1979
JP 06347048 12/1994
(Continued)

OTHER PUBLICATIONS

"International Search Report (Form PCT/ISA/210) of PCT/JP2018/026558," dated Oct. 2, 2018, with English translation thereof, pp. 1-4.

*Primary Examiner* — Steven B Mcallister
*Assistant Examiner* — John E Bargero
(74) *Attorney, Agent, or Firm* — JCIPRNET

(57) ABSTRACT

A heating and hot water supply system includes: a combustion means; a heat exchanger; a heating terminal; a circulation passage that connects the heat exchanger and the heating terminal; a circulation means; a bypass passage branched from the circulation passage and bypassing the heating terminal; a distribution means for distributing a heating medium to the circulation passage and the bypass passage; a hot water supply heat exchanger for the bypass passage; and a hot water supply passage; wherein the distribution means can adjust the distribution ratio so as to correspond to a heating operation, a hot water supply operation, and a simultaneous heating and hot water supply operation, and when the distribution ratio on the circulation passage side of the distribution means is smaller than a prescribed value during the simultaneous heating and hot water supply operation, the blowing operation of the blower at the heating terminal is prohibited.

2 Claims, 1 Drawing Sheet

(56) References Cited

FOREIGN PATENT DOCUMENTS

| | | |
|---|---|---|
| JP | 2005180742 | 7/2005 |
| JP | 2005337632 | 12/2005 |
| JP | 2011033255 | 2/2011 |
| JP | 2011515647 | 5/2011 |
| JP | 2014163590 | 9/2014 |

* cited by examiner

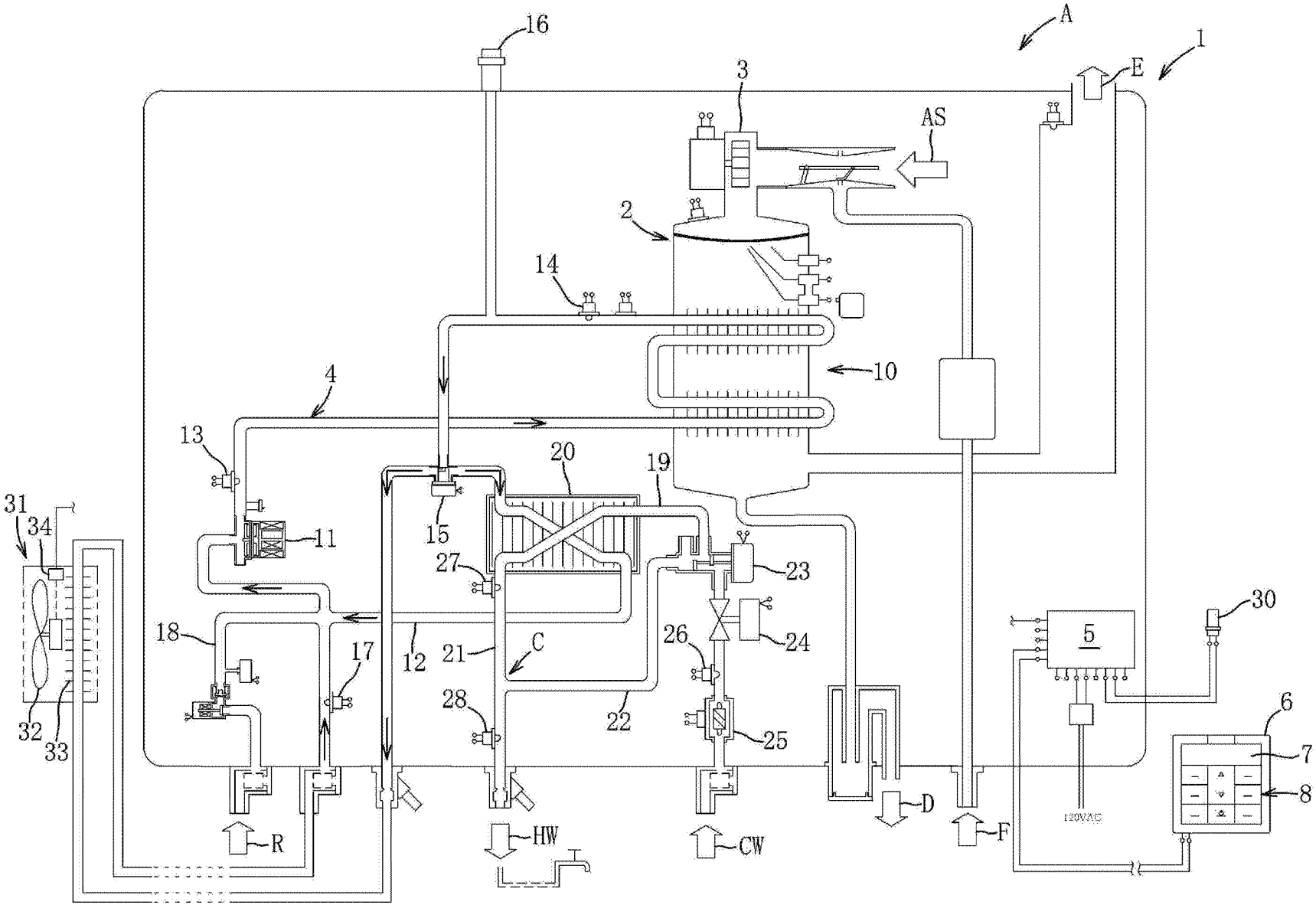
1
A
E
AS
3
2
16
14
10
4
13
11
15
12
17
18
20
19
21
C
22
23
24
25
26
27
28
5
30
6
7
8
F
D
CW
HW
R
31
34
32
33

HEATING AND HOT WATER SUPPLY SYSTEM

CROSS-REFERENCE TO RELATED APPLICATION

This application is a 371 application of the International PCT application serial no. PCT/JP2018/026558, filed on Jul. 13, 2018, which claims the priority benefit of Japanese Application No. 2017-142603 filed Jul. 24, 2017. The entirety of each of the above-mentioned patent applications is hereby incorporated by reference herein and made a part of this specification.

BACKGROUND OF THE INVENTION

Technical Field

The present invention relates to a heating and hot water supply system capable of performing a heating operation in which a heating medium heated by combustion heat is supplied to a heating terminal to perform heating and a hot water supply operation in which tap water is heated by heat exchange with the heating medium to supply hot water, particularly relates to a heating and hot water supply system capable of simultaneously performing the heating operation and the hot water supply operation.

Related Art

Conventionally, a warm water heating system is widely used, in which heating is performed by using a heating means to heat hot water that is a heating heat medium and supplying the hot water to a heating terminal. In the warm water heating system, for example, immediately after the start of a heating operation, the temperature of the heating medium supplied to the heating terminal is lower than a preset heating temperature, and thus blowing is performed at a low temperature when a blower is operated at the heating terminal, which may give discomfort to a user. In order to prevent the low-temperature blowing, for example, as in patent literature 1, the operation of the blower is prohibited when the temperature of the heating medium is low.

On the other hand, a heating and hot water supply system is known in which the heating terminal is connected to a heating and hot water supply device capable of performing each of the heating operation, the hot water supply operation, and the simultaneous heating and hot water supply operation. This heating and hot water supply system includes a distribution means that distributes the heating medium heated to a preset heating terminal setting temperature for heating and for hot water supply, and adjusts the distribution ratio of the distribution means to enable the simultaneous heating and hot water supply operation.

LITERATURE OF RELATED ART

Patent Literature

Patent literature 1: Japanese Patent Laid-open No. 6-347048

SUMMARY

Problems to be Solved

The heating and hot water system that performs simultaneous heating and hot water supply operation is configured to prioritize hot water supply and adjust the distribution ratio of the distribution means during the simultaneous heating and hot water supply operation. Therefore, immediately after the start of the simultaneous heating and hot water supply operation or when a hot water supply load is large, the distribution ratio of the heating medium for heating is reduced, and the heating medium supplied to the heating terminal is decreased. If the supply amount of the heating medium is small, a sufficient amount of heat cannot be supplied to the heating terminal even if the temperature of the heating medium is the heating terminal setting temperature, and thus the blowing is performed at the low temperature when the blower of the heating terminal is operated, which may give discomfort to the heating user.

The present invention is to provide a heating and hot water supply system which is capable of prohibiting a blowing operation of a heating terminal when there is a possibility of low-temperature blowing of the heating terminal.

Means to Solve Problems

The invention of technical solution 1 is a heating and hot water supply system including: a combustion means; a heat exchanger for heating a heating medium with heat generated by the combustion means; a heating terminal having a blower; a circulation passage that connects the heat exchanger and the heating terminal; a circulation means arranged in the circulation passage to circulate the heating medium; a bypass passage branched from the circulation passage and bypassing the heating terminal; a distribution means for distributing the heating medium to the circulation passage and the bypass passage; a hot water supply heat exchanger arranged in the bypass passage; a water supply passage for supplying tap water to the hot water supply heat exchanger; and a hot water supply passage for supplying hot water heated by the hot water supply heat exchanger at a prescribed hot water supply setting temperature; the distribution means can adjust the distribution ratio so as to correspond to a heating operation, a hot water supply operation, and the simultaneous heating and hot water supply operation, and when the distribution ratio on the circulation passage side of the distribution means is smaller than a prescribed value during the simultaneous heating and hot water supply operation, the blowing operation of the blower at the heating terminal is prohibited.

According to the configuration, the heating and hot water supply system adjusts the distribution ratio of the distribution means that distributes the heating medium to the circulation passage and the bypass passage during the simultaneous heating and hot water supply operation. At this time, when the distribution ratio to the heating terminal on the circulation passage side is smaller than the prescribed value, the blowing operation of the blower at the heating terminal is prohibited, and thus the low-temperature blowing with insufficient air heating due to a lack of heat at the heating terminal can be prevented.

The invention of technical solution 2 is the heating and hot water supply system of technical solution 1, wherein the heating medium is heated to the heating terminal setting temperature and is circulated during the simultaneous heating and hot water supply operation.

According to the configuration, even if the temperature of the heating medium is the heating terminal setting temperature set for heating operation, when the distribution ratio on the circulation passage side is smaller than the prescribed value and thus the amount of heat supplied to the heating terminal is insufficient during the simultaneous heating and hot water supply operation, the blowing operation of the blower at the heating terminal can be prohibited and the low-temperature blowing can be prevented.

Effect

According to the present invention, low-temperature blowing during simultaneous heating and hot water supply operation can be prevented.

BRIEF DESCRIPTION OF THE DRAWINGS

FIG. 1 is a diagram showing an overall configuration of a heating and hot water supply system of an example of the present invention.

DESCRIPTION OF THE EMBODIMENTS

Embodiments for implementing the present invention are described below based on examples.

Example

First, an overall configuration of a heating and hot water supply system A of the present invention is described with reference to FIG. 1.

The heating and hot water supply system A includes a heating and hot water supply device 1 and a heating terminal 31, and is configured to be capable of performing a heating operation and a hot water supply operation, wherein the heating operation is performed by circulating a heating medium heated by the heating and hot water supply device 1 between the heating and hot water supply device 1 and the heating terminal 31, and the hot water supply operation is performed by tap water heated using the heat of the heating medium is adjusted to a hot water supply setting temperature to supply hot water.

Next, the heating and hot water supply device 1 is described.

The heating and hot water supply device 1 includes a combustion portion 2 serving as a combustion means, a heat exchanger 10, a circulation passage 4 that connects the heat exchanger 10 and the heating terminal 31, a circulation pump 11 serving as a circulation means arranged upstream of the heat exchanger 10 in the circulation passage 4, and the like. The combustion portion 2 includes a combustion blower 3, and burns a gas mixture supplied by mixing supply air indicated by an arrow AS and a fuel gas indicated by an arrow F through the combustion blower 3. The amount of the generated combustion gas and the amount of combustion heat are adjusted by controlling a rotation speed of the combustion blower 3. The heat exchanger 10 exchanges heat between the combustion gas generated by the combustion portion 2 and the heating medium, and heats the heating medium to a preset heating terminal setting temperature. The combustion gas of which the temperature decreases due to the heat exchange is exhausted outside as indicated by an arrow E. An arrow D shows drainage.

In addition, the heating and hot water supply device 1 includes a first bypass passage 12 (a bypass passage), a hot water supply heat exchanger 20 arranged in the first bypass passage 12, a water supply passage 19, a hot water supply passage 21, and the like. The first bypass passage 12 is branched from the circulation passage 4 on the downstream side of the heat exchanger 10 to bypass the heating terminal 31, and joins the circulation passage 4 on the upstream side of the circulation pump 11. The water supply passage 19 supplies tap water to the hot water supply heat exchanger 20 as indicated by an arrow CW. The hot water supply passage 21 supplies hot water heated by the hot water supply heat exchanger 20 to a hot water supply plug or the like as indicated by an arrow HW.

Furthermore, the heating and hot water supply device 1 includes a control portion 5 that controls the heating operation or the like. An operation terminal 6 for performing a setting operation or the like of the heating and hot water supply device 1 is communicably connected to the control portion 5 and is arranged, for example, in the room where heating is performed by the heating terminal 31. In addition, an outdoor temperature sensor 30 disposed outdoors is communicably connected to the control portion 5.

Next, the circulation passage 4 is described.

The circulation passage 4 includes a first temperature sensor 13 between the circulation pump 11 and the heat exchanger 10, and a second temperature sensor 14 on the downstream side of the heat exchanger 10. The first temperature sensor 13 detects the temperature of the heating medium flowing into the heat exchanger 10. The second temperature sensor 14 detects the temperature of the heating medium heated by the heat exchanger 10.

A first distribution valve 15 serving as a distribution means is arranged in the branch portion between the circulation passage 4 and the first bypass passage 12. The first distribution valve 15 distributes the heating medium heated by the heat exchanger 10 to the circulation passage 4 and the first bypass passage 12 so as to correspond to the heating operation, the hot water supply operation, and the simultaneous heating and hot water supply operation, and the distribution ratio of the first distribution valve 15 is adjustable. The heating medium distributed to the circulation passage 4 by the first distribution valve 15 is supplied to the heating terminal 31, and the heating medium distributed to the first bypass passage 12 is supplied to the hot water supply heat exchanger 20.

A pressure release valve 16 which releases the pressure in the circulation passage 4 is arranged between the heat exchanger 10 and the first distribution valve 15. A heating return temperature sensor 17 which detects the temperature of the heating medium returning from the heating terminal 31 is arranged on the upstream side of the circulation pump 11. A replenishment passage 18 for replenishing the heating medium as shown by an arrow R is connected between the circulation pump 11 and the heating return temperature sensor 17.

Next, the hot water supply heat exchanger 20 is described. The hot water supply heat exchanger 20 is a plate-type heat exchanger, and passages are formed among a plurality of laminated heat exchange plates. In the hot water supply heat exchanger 20, the heating medium and the tap water supplied from the water supply passage 19 alternately flow through the passages among the heat exchange plates in a way that the tap water supplied from the water supply passage 19 face each other without being mixed with each other. On these heat exchange plates, irregularities are formed to expand the surface area and improve the heat exchange efficiency.

Next, the water supply passage 19 and the hot water supply passage 21 are described. The water supply passage 19 includes a second distribution valve 23, a flow rate adjustment valve 24, a hot water supply flow rate sensor 25, and an entering water temperature sensor 26. By opening the hot water supply plug or the like, the tap water is supplied to the water supply passage 19 as indicated by the arrow CW. The second bypass passage 22 (the hot water supply bypass passage) is branched from the water supply passage 19, and the second distribution valve 23 arranged in the branch portion distributes the tap water to the water supply passage 19 and the second bypass passage 22 and the ratio of the second distribution valve 23 is adjustable. Accordingly, the second distribution valve 23 is a flow rate adjustment means which adjusts a flow rate of the tap water flowing through the second bypass passage 22. The flow rate adjustment valve 24 adjusts the flow rate of the tap water entering the second distribution valve 23. The hot water supply flow rate sensor 25 detects the flow rate of the tap water supplied to the second distribution valve 23. The entering water temperature sensor 26 detects the temperature of the tap water entering the second distribution valve 23.

The second bypass passage 22 joins the hot water supply passage 21 in a junction portion C. A hot water discharge temperature sensor 27 is arranged between the junction portion C and the hot water supply heat exchanger 20. The hot water discharge temperature sensor 27 detects the temperature of the hot water discharged from the hot water supply heat exchanger 20. A hot water supply temperature sensor 28 is arranged at the downstream end of the hot water supply passage 21. The hot water supply temperature sensor 28 detects the hot water supply temperature of the hot water obtained by mixing and supplying hot water heated by the hot water supply heat exchanger 20 and tap water flowing through the second bypass passage 22. In the hot water supply operation, the second distribution valve 23 is controlled so that the hot water supply temperature becomes the hot water supply setting temperature.

Next, the control portion 5 is described.

The control portion 5 is connected to be capable of receiving a detection signal of the first temperature sensor 13 or the like arranged in the heating and hot water supply device 1 or receiving the rotation speed or the like of the combustion blower 3 or the like as a detection signal, and capable of setting a set value such as the rotation speed of the combustion blower 3 or the distribution ratio of the first distribution valve 15. Then, by controlling the combustion blower 3, the circulation pump 11, the first distribution valve 15 or the like based on the detection signal and the set value, each of the heating operation, the hot water supply operation, and the simultaneous heating and hot water supply operation is controlled.

For example, when there is a request for hot water supply operation during the heating operation, the control portion 5 determines whether the simultaneous heating and hot water supply operation is possible based on the detection signal, the set value, the heating capacity of the heating and hot water supply device 1, and the like. When it is determined that the simultaneous heating and hot water supply operation is possible, the simultaneous heating and hot water supply operation is performed, and when it is determined that the simultaneous heating and hot water supply operation is impossible, the heating operation is stopped and the hot water supply operation is performed.

Next, the operation terminal 6 is described.

The operation terminal 6 includes a display portion 7 capable of displaying, for example, temperature, operation status or the like, a switch portion 8 for performing a setting operation of the heating temperature or the hot water supply temperature or a start operation of the heating operation or the like, and a sound output portion that outputs a warning sound or the like, but sound output portion is not shown.

Next, the heating terminal 31 is described.

The heating terminal 31 includes a heating blower 32 (a blower), a heating heat exchanger 33 for performing heat exchange between the heating medium and air, and a heating terminal control portion 34 that controls an operation of the heating terminal 31, and the heating terminal 31 performs heating by heating the introduced air with the heating heat exchanger 33 and blowing out warm air. For example, when the heating terminal 31 is an air handler, by the blowing operation of the heating blower 32, the indoor air and the outside air taken into the heating terminal 31 are heated by the heating heat exchanger 33 and the warm air is blown indoors. The heating terminal 31 may be a heating device that heats and blows the indoor air.

The temperature of the heating medium required by the heating terminal 31 is set to the heating terminal setting temperature during construction or the like for connecting the heating terminal 31 to the heating and hot water supply device 1. The heating terminal setting temperature is usually set to about 60° C.-80° C. The heating terminal control portion 34 is communicably connected to the control portion 5 of the heating and hot water supply device 1, and when there is a request for heating operation from the heating terminal 31 or when the heating operation is started by operation of the operation terminal 6 of the heating and hot water supply device 1, the heating terminal control portion 34 controls the heating operation in cooperation with the control portion 5.

Next, the heating operation is described.

In the heating operation, in order to supply the heating medium heated to the heating terminal setting temperature to the heating terminal 31, the distribution ratio of the first distribution valve 15 is adjusted in a way that the heating medium flows through the circulation passage 4. At this time, the first distribution valve 15 is adjusted in a way that the flow rate of the heating medium distributed to the circulation passage 4 side is substantially the same as the flow rate of the heating medium supplied to the first distribution valve 15, and the distribution ratio on the circulation passage 4 side of the heat medium is substantially 100%. The heating medium flows through the circulation passage 4 and heats the air in the heating heat exchanger 33, and then returns to the heat exchanger 10. The air heated in the heating heat exchanger 33 is blown indoors by the blowing operation of the heating blower 32.

Next, the hot water supply operation is described.

In the hot water supply operation, in order to supply, to the hot water supply heat exchanger 20, the heating medium that is heated to a temperature higher than the hot water supply setting temperature by the heat exchanger 10 in a way that hot water supply at the hot water supply setting temperature is possible, the distribution ratio of the first distribution valve 15 is adjusted in a way that the heating medium flows through the first bypass passage 12. At this time, the distribution ratio of the heating medium on the first bypass passage 12 side is substantially 100%. For example, usually the hot water supply setting temperature is set to about 42° C., and when the heating terminal setting temperature is set to 60° C. which is higher than the hot water supply setting temperature, the heating medium is also heated to the heating terminal setting temperature during the hot water supply operation.

On the other hand, during high-temperature hot water supply, the heating medium can be heated to a temperature higher than the heating terminal setting temperature and supplied to the hot water supply heat exchanger 20. For example, when the heating terminal setting temperature and the hot water supply setting temperature are both set to 60° C. and it is difficult to supply hot water at the hot water supply setting temperature by the heating medium at the heating terminal setting temperature, the heating medium is heated to a temperature (for example, 70° C.) at which the high-temperature hot water supply at the hot water supply setting temperature is possible.

The heated heating medium exchanges heat with the tap water supplied from the water supply passage 19 by the hot water supply heat exchanger 20, and then returns to the heat exchanger 10. The hot water heated to a temperature higher than the hot water supply setting temperature by the hot water supply heat exchanger 20 is adjusted to the hot water supply setting temperature by being mixed with the tap water of the second bypass passage 22 in the hot water supply passage 21 and is supplied to the hot water supply plug or the like.

Next, the simultaneous heating and hot water supply operation is described. When it is determined by the control portion 5 that the simultaneous heating and hot water supply operation is possible, the heating and hot water supply system A adjusts the distribution ratio of the first distribution valve 15 in a way that the hot water supply operation can be given priority to supply the hot water at the hot water supply setting temperature. Then, the heating medium heated to the heating terminal setting temperature by the heat exchanger 10 is distributed to the circulation passage 4 and the first bypass passage 12, and the heating medium is supplied to the heating terminal 31 and the hot water supply heat exchanger 20. The tap water heated by the hot water supply heat exchanger 20 is adjusted to the hot water supply setting temperature in the hot water supply passage 21 and supplied to the hot water supply plug or the like. The heating terminal 31 blows the air heated in the heating heat exchanger 33 by the blowing operation of the heating blower 32 to perform heating.

The distribution ratio of the heating medium on the circulation passage 4 side is temporarily set to substantially 0% immediately after the start of the simultaneous heating and hot water supply operation due to priority of the hot water supply operation, and then gradually increases when the hot water supply at the hot water supply setting temperature is stabilized. The control portion 5 transmits a prohibition signal for blowing operation to the heating terminal 31 immediately after the start of the simultaneous heating and hot water supply operation, and the heating terminal control portion 34 receives the prohibition signal and stops the blowing operation. When the distribution ratio on the circulation passage 4 side is a prescribed value or higher, the control portion 5 transmits a prohibition releasing signal for blowing operation, and the heating terminal control unit 34 receives the prohibition releasing signal and restarts the blowing operation. Besides, the prescribed value of the distribution ratio on the circulation passage 4 side is set to 30% for example, but it is not limited to the above distribution ratio and can be set appropriately according to the heating capacity of the heating terminal 31, the heating capacity of the heating and hot water supply device 1 or the like.

Next, the action and effect of the heating and hot water supply system A of the present invention is described.

The heating and hot water supply device 1 adjusts the distribution ratio of the first distribution valve 15 and can distribute the heating medium to the circulation passage 4 and the first bypass passage 12. When the distribution ratio on the circulation passage 4 side is small, the amount of heat supplied to the heating terminal 31 is small, and thus the air cannot be sufficiently heated by the heating heat exchanger 33. At this time, if the heating terminal 31 performs the blowing operation, low-temperature air is sent, which may cause discomfort to the heating user. In order to prevent the low-temperature blowing, the heating and hot water supply system A prohibits the blowing operation of the heating terminal 31 when the distribution ratio on the circulation passage 4 side is smaller than a prescribed value. Accordingly, by prohibiting the blowing operation, the low-temperature blowing can be prevented, and the heating user will not feel uncomfortable.

In addition, the heating and hot water supply system A adjusts the distribution ratio in a way that the heating medium heated to the heating terminal setting temperature by the heat exchanger 10 is distributed to the heating terminal 31 and the hot water supply heat exchanger 20 by the first distribution valve 15 during the simultaneous heating and hot water supply operation. Accordingly, even if the temperature of the heating medium is the heating terminal setting temperature, the blowing operation of the heating terminal 31 can be prohibited when the amount of heat supplied to the heating terminal 31 is small and the low-temperature blowing can be prevented. In addition, even if the blowing operation is prohibited, supply of the heating medium to the heating terminal 31 continues due to continuation of the simultaneous heating and hot water supply operation, and thus the temperature decrease of the heating terminal 31 can be prevented and the low-temperature blowing can be prevented when the blowing operation is restarted.

When the heating terminal 31 is an air handler in which the amount of heat for heating is insufficient during the simultaneous heating and hot water supply operation due to introduction of the outside air and the low-temperature blowing easily occurs, the low-temperature blowing can be more effectively prevented by prohibiting the blowing operation.

The above example is configured to determine whether the simultaneous heating and hot water supply operation is possible; however, the determination may be omitted and the distribution ratio of the first distribution valve 15 may be adjusted to perform the simultaneous heating and hot water supply operation. Even in this configuration, it is configured in a way that the blowing operation of the heating terminal 31 can also be prohibited when the distribution ratio on the circulation passage 4 side is smaller than the prescribed value during the simultaneous heating and hot water supply operation, and the low-temperature blowing can be prevented. In addition, those skilled in the art can implement the present invention in aspects where various modifications are applied to the above embodiment without departing from the gist of the present invention, and the present invention includes the modification aspects.

What is claimed is:

1. A heating and hot water supply system, comprising: a combustion component configured to generate heat, a heat exchanger for heating a heating medium with the heat generated by the combustion component, a heating terminal having a blower, a circulation passage that connects the heat exchanger and the heating terminal, a circulation pump arranged in the circulation passage to circulate the heating medium, a bypass passage branched from the circulation passage and bypassing the heating terminal, a distribution valve for distributing the heating medium to the circulation passage and the bypass passage, a hot water supply heat exchanger arranged in the bypass passage, a water supply passage for supplying tap water to the hot water supply heat exchanger, and a hot water supply passage for supplying hot water heated by the hot water supply heat exchanger at a prescribed hot water supply setting temperature;

wherein the distribution valve is capable of adjusting the distribution ratio so as to correspond to a heating operation, a hot water supply operation, and a simultaneous heating and hot water supply operation, and when the simultaneous heating and hot water supply operation starting, the distribution ratio of the heating medium on the circulation passage side is temporarily set to 0% immediately and then gradually increases, the blowing operation of the blower at the heating terminal is prohibited when the distribution ratio on the circulation passage side of the distribution valve is smaller than a prescribed value, and prohibition of the blowing operation is released when the distribution ratio on the circulation passage side is the prescribed value or higher.

2. The heating and hot water supply system according to claim 1, wherein the heating medium is heated to a heating terminal setting temperature and is circulated during the simultaneous heating and hot water supply operation.

* * * * *